US009986804B2

(12) United States Patent
Godart

(10) Patent No.: US 9,986,804 B2
(45) Date of Patent: Jun. 5, 2018

(54) DEVICE FOR CARRYING EYEWEAR

(71) Applicant: Fred Thomas Godart, Fort Lauderdale, FL (US)

(72) Inventor: Fred Thomas Godart, Fort Lauderdale, FL (US)

( * ) Notice: Subject to any disclaimer, the term of this patent is extended or adjusted under 35 U.S.C. 154(b) by 179 days.

(21) Appl. No.: 14/964,866

(22) Filed: Dec. 10, 2015

(65) Prior Publication Data

US 2016/0166027 A1 Jun. 16, 2016

Related U.S. Application Data

(60) Provisional application No. 62/090,626, filed on Dec. 11, 2014.

(51) Int. Cl.

| | |
|---|---|
| ***A45F 5/00*** | (2006.01) |
| ***A45C 11/04*** | (2006.01) |
| ***A45C 13/00*** | (2006.01) |
| ***A45C 13/10*** | (2006.01) |

(52) U.S. Cl.

CPC ..... *A45C 11/04* (2013.01); *A45C 13/007* (2013.01); *A45C 13/1069* (2013.01)

(58) Field of Classification Search

CPC ... A45C 11/04; A45C 13/007; A45C 13/1069; A45F 5/00

USPC .... 224/669, 679, 240, 241, 252, 253; 206/5, 206/6

See application file for complete search history.

(56) References Cited

U.S. PATENT DOCUMENTS

| | | | | | |
|---|---|---|---|---|---|
| 3,051,130 | A * | 8/1962 | Morris | A45F 5/02 | 206/268 |
| 3,845,799 | A * | 11/1974 | Mittell | A45C 11/04 | 150/105 |
| 4,161,201 | A * | 7/1979 | Carp | A45C 13/02 | 150/113 |
| 4,887,751 | A * | 12/1989 | Lehman | A45C 5/14 | 190/1 |
| 4,984,682 | A * | 1/1991 | Cummins | A45C 11/04 | 206/5 |
| 5,002,401 | A * | 3/1991 | Blackman | A45C 7/0095 | 150/112 |
| 5,261,582 | A * | 11/1993 | Mathews | A45C 11/04 | 206/5 |
| 5,312,029 | A * | 5/1994 | Tuber | A45C 11/04 | 224/241 |
| 5,395,023 | A * | 3/1995 | Naymark | A45C 11/38 | 224/199 |

(Continued)

*Primary Examiner* — Brian D Nash

(57) ABSTRACT

A device for carrying eyewear comprising a hollow body having an upwardly protruding feature located inside the cavity protruding upward from a bottom section. A front section and top section are configured to open away from a back to provide access to the cavity from above the hollow body. A spring biased hinged clip is configured to couple the hollow body to a waist belt. A second spring biased hinged clip is configured for retaining against an inside surface of the hollow body a piece of material configured for cleaning an eyewear lens. A pocket is configured to hold to a communication tag configured for wireless communication with a monitoring device, wherein the monitoring device is configured for sending an alert message for display on a user interface of a remote computing device if the monitoring device determines that a proximity is greater than a threshold proximity.

19 Claims, 6 Drawing Sheets

(56) References Cited

U.S. PATENT DOCUMENTS

| | | | | | |
|---|---|---|---|---|---|
| D362,751 | S * | 10/1995 | Kopel | D3/233 | |
| 5,501,321 | A * | 3/1996 | Liu | A45C 11/04 | 206/5 |
| 5,706,935 | A * | 1/1998 | Lorton | A45C 11/008 | 150/117 |
| 5,899,371 | A * | 5/1999 | Weliver | A45C 11/24 | 150/112 |
| 6,003,663 | A * | 12/1999 | Newcomer | A45C 11/04 | 206/315.1 |
| 6,026,950 | A * | 2/2000 | Wisniewski | A45C 11/04 | 206/6 |
| 6,216,930 | B1 * | 4/2001 | Plocher | A45C 11/04 | 206/5 |
| 6,293,445 | B1 * | 9/2001 | Miller | A45F 3/00 | 224/236 |
| 6,546,599 | B2 * | 4/2003 | Pelt | A45F 5/022 | 224/222 |
| 7,690,542 | B1 * | 4/2010 | Silvera | A45C 11/00 | 224/237 |
| 2005/0040200 | A1 * | 2/2005 | Shen | A45F 5/02 | 224/670 |
| 2005/0092791 | A1 * | 5/2005 | Labarca | A45F 5/02 | 224/269 |
| 2005/0155872 | A1 * | 7/2005 | Cheng | A45C 11/04 | 206/6 |
| 2009/0301911 | A1 * | 12/2009 | Rubin | A01K 97/06 | 206/315.11 |

* cited by examiner

DEVICE FOR CARRYING EYEWEAR

CROSS-REFERENCE TO RELATED APPLICATIONS

This application claims the benefit of the filing date of U.S. Provisional Application Ser. No. 62/096,626 filed Dec. 11, 2014 and the subject matter of which is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The current invention relates to the field of eyewear, and more specifically to the field of eyewear cases.

BACKGROUND

Many people have poor vision. When a person has poor vision, many times that person wears either contact lenses or glasses. Sometimes even if a person is not required to wear eyeglasses or contact lenses, he or she may choose to wear sunglasses to protect their eyes from solar rays or eyeglasses for aesthetic purposes. Many people that wear eyeglasses or sunglasses choose to store such eyeglasses and sunglasses in cases.

Eyeglasses and sunglasses cases have padding on the inside to prevent scratching of the lenses of either the eyeglasses or sunglasses. Such cases may be a hard case or a soft pouch that protects the lenses. In the past, such sunglasses or eyeglasses cases have been bulky or cumbersome. When a sunglasses or eyeglasses case is bulky, it may become difficult for a person to carry.

Because sunglasses or eyeglasses cases are difficult to carry, many times people do not use a sunglasses or eyeglasses case to protect the sunglasses or eyeglasses. Because of this, many times a person's sunglasses or eyeglasses can become lost or scratched. At times, a person is forced to store the sunglasses or eyeglasses in places not intended for storing or carrying sunglasses or eyeglasses, such as in a person's pocket or along a person's collar.

Another problem with existing eyeglasses cases or sunglasses cases is that many times a person may misplace or lose the case. When this happens, a person may be required to purchase an additional pair of sunglasses or eyeglasses and an additional case. This increases the cost of eye care. Another problem with existing eyewear cases is that many times a person is unable to carry a piece of eyewear lens cleaning material or cloth inside of the case. Eyewear cases have a limited amount of space for carrying items. Many times there is not enough space inside of a case to carry both a cleaning cloth and eyewear. Many times a cleaning cloth haphazardly inserted into an eyewear case and can cause the eyewear to not properly fit inside the case, which may damage the eyewear.

Another problem with existing eyeglasses or sunglasses cases is that many times a person is unable to store such cases on their person. Many times cases are too large to fit inside of a pants pocket or shirt pocket and as a result the person is unable to prevent scratching of the lenses of a pair of sunglasses or eyeglasses. As a result, based upon the all of the problems listed above, there is a need for improvement over the prior art.

SUMMARY

A device for carrying eyewear is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope. In one embodiment, the device comprises a hollow body defining a cavity adapted to receive eyewear, such as sunglasses or eyeglasses.

The device comprises a hollow body defining a cavity configured for receiving eyewear. An upwardly protruding feature is located inside the cavity protruding upward from a bottom section of the body. Said upwardly protruding feature is adapted for maintaining said eyewear in a particular position when said eyewear is inside the cavity. A front section and top section of said hollow body is pivotally coupled to a bottom section of the body. The front section and top section are configured to open away from a back section of said body to provide access to the cavity from above the hollow body. A spring biased hinged clip is coupled to an outward facing surface of the back section of the body, wherein the spring biased hinged clip is configured to couple the hollow body to a waist belt. The spring biased hinged clip comprises a catching feature at a first end of the spring biased hinged clip, and wherein the catching device defines a flange protruding inward toward the back section of the body. A second spring biased hinged clip is coupled to an inside surface of the hollow body, wherein the second spring biased hinged clip is configured for retaining against an inside surface of the hollow body a piece of material configured for cleaning an eyewear lens. A pocket is coupled to the outward facing surface of the back section of the hollow body, wherein the pocket is configured to hold a communication tag configured for wireless communication with a monitoring device. A communication tag is configured for transmitting a signal to a monitoring device, wherein the signal is configured for being received by the monitoring device, and wherein the monitoring device is configured for monitoring a proximity of the communication tag relative to the monitoring device based upon the signal received, and wherein the monitoring device is configured for sending an alert message for display on a user interface of a remote computing device if the monitoring device determines that the proximity is greater than a threshold proximity.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION

Figure 1B:
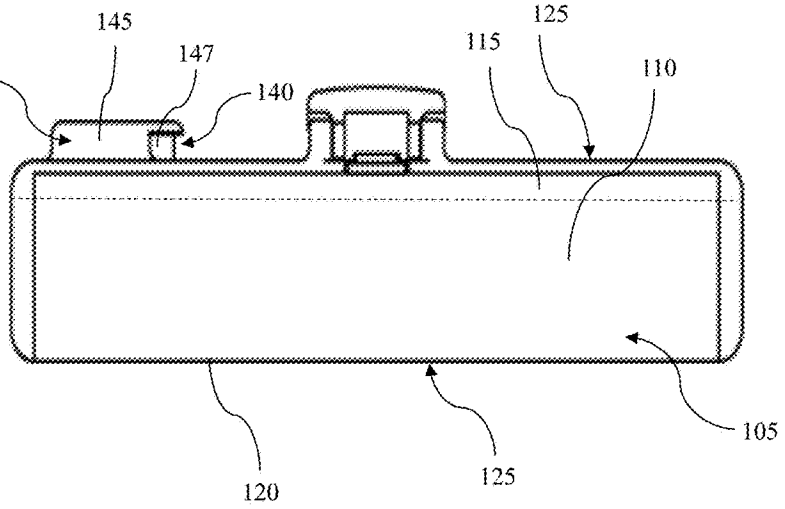
FIG. 1B is an illustration of a top view of the device for carrying eyewear in the closed position, according to one embodiment of the present invention.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

In one embodiment, a device for carrying eyewear that can be attachable to a wearer's belt or portion of clothing is disclosed. The present invention improves over the prior art by providing a more aesthetically pleasing way to store and carry eyeglasses. Additionally, the present invention improves over the prior art by providing a system for monitoring the location of eyewear relative to a remote computing device, typically a mobile smart phone, so that a person can easier locate eyewear and his or her case. The device also provides a system for notifying a user if he or she leaves or forgets their eyewear and case, which will reduce the amount of money a user will have to spend if he or she has to re-purchase their glasses.

Another improvement over the prior art is that the present invention provides a user with an easy access to eyeglasses or sunglasses when worn on the belt. Another improvement over the prior art is that the invention provides a user with a less bulky way of storing eyeglasses or sunglasses. Another improvement over the prior is that the present invention provides a system for neatly including material used for cleaning eyewear within an eye glass case. Yet another improvement over the prior art is that device provides a stop means for preventing eyewear from inadvertently falling out of the case when the case is open.

Figure 1A:
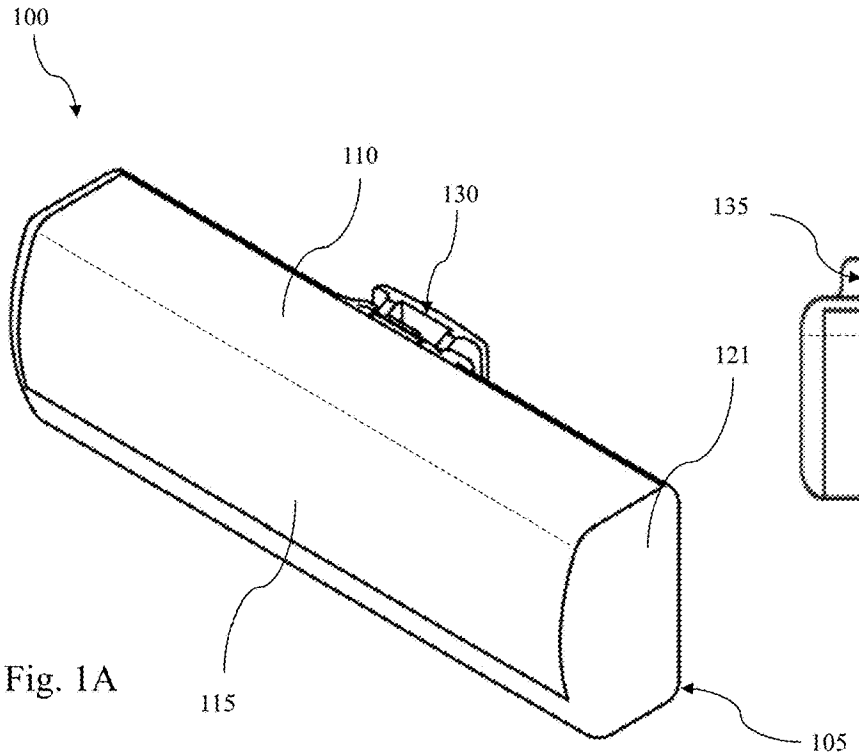
FIG. 1A is an illustration of a prospective view of a device for carrying eyewear in a closed position, according to one embodiment of the present invention.

Referring to the Figures, FIGS. 1A, 1B, 3A and 4B are illustrations of a device 100 for carrying eyewear in a closed state or position. FIGS. 2A, 2B, 3B and 4A are illustrations of the device for carrying eyewear in an open state or position. FIG. 1A is an illustration of a prospective view of the device for carrying eyewear in a closed position, according to one embodiment of the present invention. The device is configured to attach to a waist belt of a person's clothing and to provide a user with easy access to an eyeglass device. The device includes a hollow body 105 having a top section 110 opposing a bottom section 210, a front section 115 opposing a back section 120, and two side sections 121. Each of the sections are substantially rectangular planar shaped bodies. When in the open position, the hollow body defines a cavity 205. The cavity of the hollow body is configured for receiving eyewear. The eyewear may be eyeglasses, bifocals, sunglasses or any combination thereof. In the present embodiment, the device comprises a generally rectangular shaped hollow body.

The front section 115 and top section 110 of the hollow body are pivotally coupled to the bottom section of the body. As illustrated in the figures demonstrating the open state (FIGS. 2A, 2B, 3B and 4A), the front section and top section are configured to open away from the back section 120 of the hollow body to provide access to the cavity from above the hollow body. The ability of the top and front section to be pivoted away from the back section of the device is an important feature of the invention in that allows for a user to not have to remove the case from his or her waist belt in order for eyewear to be easily removed from the inside of the hollow body. While the pivoting device used to couple the front section to the bottom section is well known to those skilled in the art, it is believed that having top section and front section open away from the back section does provide an inventive feature to the invention.

The top section of the device may also include a supplemental locking device or feature (not shown), such as a snap, button, with or otherwise to further secure the top side of the body to the back side of the body. Additionally, the top section of the hollow body may also be pivotally attached to the front section of the body to provide further access from above when in the open position.

The hollow body of the device may be formed from a variety of materials. For example, the various sides of the body may be formed from plastic, wood, aluminum, tin, metal, alloy, polymeric materials, other ferrous materials or any combination thereof. The surfaces of the inside of the body may be formed from soft material, such as velvet or cotton, such that the material facilitates the prevention of scratching of the eyeglasses or sunglasses lenses when placed inside of the device. The outside of the device may be curved slightly to further form to the curvature or contour of the waist of a wearer. The sections of the hollow body may comprise materials such as those commonly used in making eyewear cases. All these materials are those that are commonly known to those skilled in the art. It is understood that the use of other materials is within the spirit and scope of the present invention.

Figure 2B:
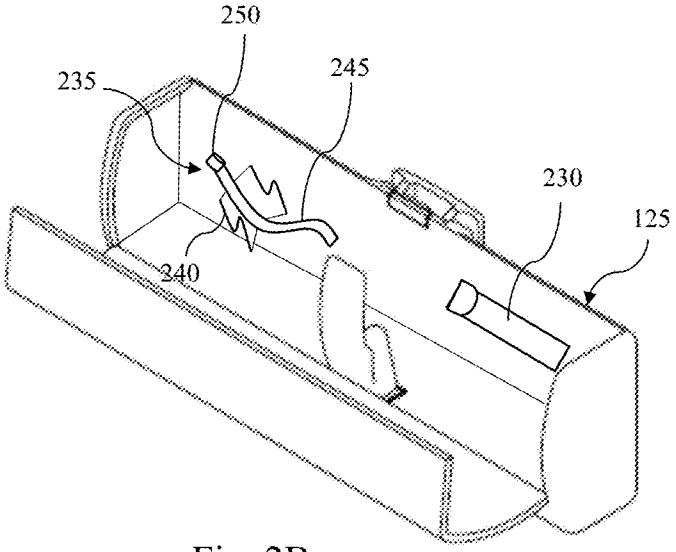
FIG. 2B is an illustration of a prospective view of the device for carrying eyewear in an open position, according to one embodiment of the present invention.

As is best illustrated when the device is in an open state (FIGS. 2A, 2B, 3B and 4A), an upwardly protruding feature 215 inside the cavity protrudes upward from the bottom section of the hollow body. The upwardly protruding feature is adapted for maintaining eyewear in a particular position when said eyewear is inside the cavity (as illustrated in FIG. 4A). In one embodiment, the upwardly protruding feature 215 includes a finger 225 proximate and outward from a nose bridge feature 220. The upwardly protruding feature protrudes substantially perpendicularly upward from the inside surface of the bottom section of the cavity. The nose bridge feature is a somewhat triangular shaped body that is configured for resting the lens pads or nose bridge of eyewear. The finger is a flattened elliptical shaped or concave shaped feature that curves slightly inward. The shape of the upwardly protruding feature 215 provides a better means for maintaining the eyewear when inside the eyeglass case. The concave profile of the finger allows a user to easily place in a particular position eyewear onto the nose bridge feature as well as provide adequate room inside the cavity for the vast majority of types of eyewear. Additionally, the finger also protects eyewear when eyewear is positioned onto the nose bridge feature. The finger prevents eyewear from falling out of the case when the case is open (as illustrated in FIG. 2B) by providing a stop that prevents movement in an outwardly direction.

An attaching device is coupled or affixed to an outward facing surface of the body. In one embodiment the attaching device is a spring biased hinged clip 130 coupled or affixed to an outward facing surface 125 of the back section. The spring biased hinged clip is configured to couple the hollow body of the case to an article of clothing or a waist belt (as is further explained below and illustrated in FIGS. 4A and 4B). The spring biased hinged clip includes a first end 305 opposing a second end 310. At the second end of the spring biased hinged clip includes a catching feature 315 (best illustrated in FIGS. 3A and 3B). The second end of the spring biased hinged clip includes a spring or hinged component 312 that allows a user open the clip so that the device can be attached to a waist belt. The spring biased hinge clip (or spring-loaded clip) uses a spring for providing a biasing force towards the outward facing surface of the back section 125. In the present embodiment, the catching feature defines a flanged section that protrudes substantially perpendicularly inward. The catching feature allows the catching feature to lay flush with the bottom section of the hollow body.

Figure 4B:
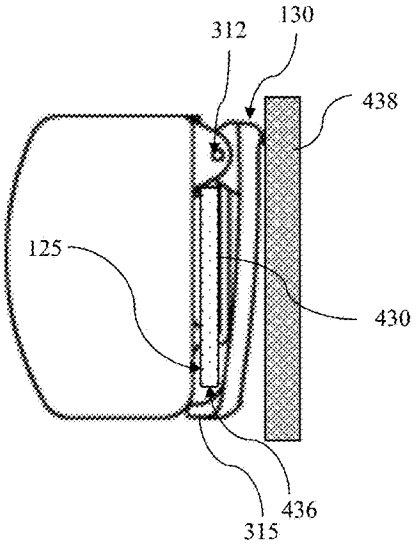
FIG. 4B is an illustration of a side view of the device for carrying eyewear in the closed position attached to a waist belt, according to one embodiment of the present invention.

As illustrated in FIGS. 4A and 4B, the spring biased clip may be used for attaching the hollow body to a waist belt 430 worn around a user's pants or article of clothing 435. The catching feature is configured for interacting with a downward facing surface 436 of the belt strap as best illustrated in FIG. 4B. In operation, when the device is attached to a belt and upward forces act upon the device, the inwardly protruding characteristics of the catching feature facilitate in maintaining the device on the belt because of the flanged section.

In other embodiments (not shown), other attaching devices may also be used. The strap may be similar to a strap of a woman's purse. The strap in one embodiments may be an elongated loop shaped body, which may be attached to a corner of the hollow shaped body 105 using a swivel type coupling or turn buckle. Additionally, turn buckles may be used for attaching other items such as key chains etc. on the device.

In yet another embodiment (not shown), the attaching device comprises a first magnet and a second magnet, wherein the first magnet is coupled to the outside of said back section and the second magnet is adapted to be positioned on an article of clothing proximate to a waist of a wearer. The first magnet is configured to mate with the second magnet. In operation, a person may affix the second magnet to an article of clothing. In order to attach the device to the article of clothing a user can bring the device within close enough proximity so that it allows the magnetic forces of the first and second magnets to couple the first and second magnets together, thereby coupling the device to the clothing being worn by the person.

In one embodiment, the device comprises a pocket 135 coupled to the outward facing surface of the back section of a hollow body. The pocket is configured to hold a communications tag 147 configured for wireless communication with a monitoring device. In one embodiment, the pocket comprises an outer part 145 having a pocket opening 140 on one end of the pocket and a pin hole 320 (best illustrated in FIG. 3A) at an opposing second end of the pocket. In the present embodiment, the pinhole is a circular shaped opening that provides access to inside the pocket. The pin hole is configured for allowing an elongated shaped body 375 (illustrated in FIG. 3C) to push in communication tag, which would be located inside of the pocket, out of the open end of the pocket.

In one embodiment the device may include a communicating device 147 that may include communication tag. The communication tag is configured for transmitting a signal to a monitoring device. The signal is configured for being received by a monitoring device. The monitoring device is configured for monitoring a proximity of communication tag relative to the monitoring device based upon the signal received. The monitoring device is configured for sending an alert message for display on a user interface of a remote computing device if the monitoring device determines that the proximity is greater than a threshold proximity.

Figure 5:
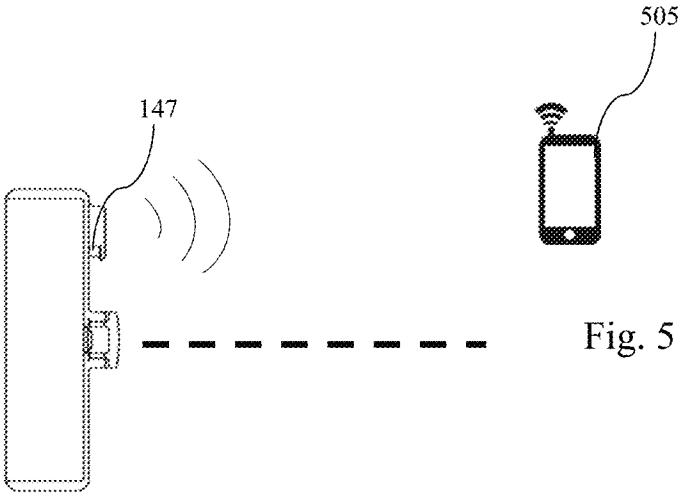
FIG. 5 is an illustration of a top view of the device for carrying eyewear communicating with a smart phone, according to one embodiment of the present invention; and, FIG. 6 is a block diagram of a computing device for use with the device for carrying eyewear, according to an example embodiment.

Referring to FIG. 5, in operation, the monitoring device may be included in either the communication device 147 or on a remote computing device 505. The monitoring device may be programmed with a predetermined threshold proximity level. A user may program the predetermined threshold proximity level into a user interface using an application or similar means. In one embodiment, the threshold proximity level corresponds to the signal strength and is relative to the distance between the remote computing device 505 and the communications tag. The signal received at the monitoring device will correspond to the distance between the communications tag and the monitoring device. The monitoring device will continuously receive the signal transmitted from the communications tag. If the signal received by the monitoring device is less than the predetermined threshold proximity level, then the monitoring device will send an alert message to the remote computing device, such as a cell phone, smart phone, tablet, etc. or any combination thereof, in order to notify or alert a consumer that the threshold proximity level is less than the predetermined setting and therefore the case is a greater distance away from the remote communication device that is desirable. In one embodiment, the method of communication between the monitoring device in communication tag may be short range communication, such as near field communication, Bluetooth™ technology, WIFI, infrared technology, ZigBee technology. It is understood that other short range communication may also be used and are within the spirit and scope of the present invention. In other embodiments, the communications device monitoring device may comprise global positioning system ("GPS") technology for monitoring the location of a user's remote computing device relative to the location of the remote communications device. If the monitoring device determines that the location of the communications device inserted into the pocket of the hollow body is greater than a predetermined distance, then an alert message is send to the user interface of a user's remote computing device to notify the user that the eyewear case is not on their person.

Figure 2A:
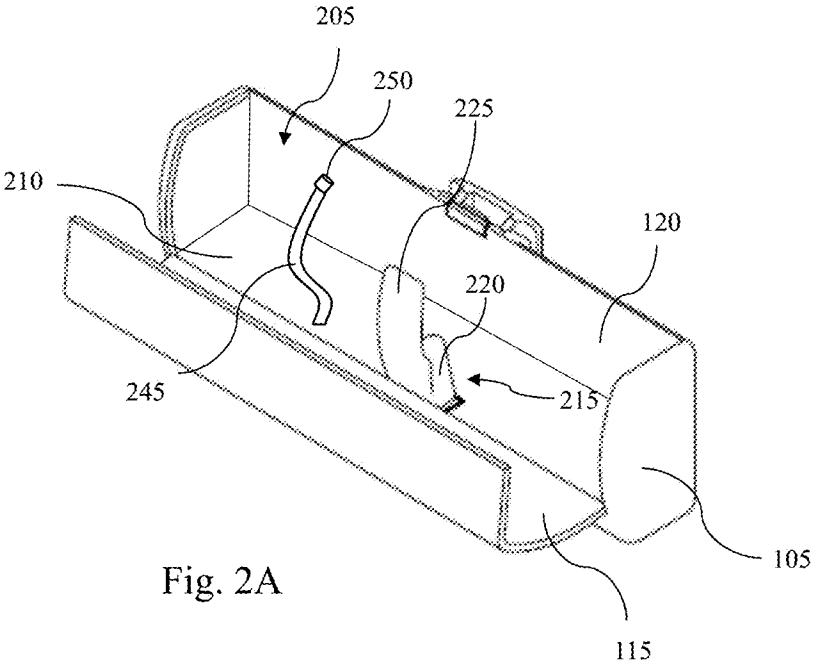
FIG. 2A is an illustration of a prospective view of the device for carrying eyewear in an open position, according to one embodiment of the present invention.

FIG. 2A is a perspective view of the hollow body in the open state having the second spring biased or loaded hinged clip having a force applied to it such that it has moved away from the back section 120 of the hollow body. In the present embodiment, the spring biased or loaded clip comprises an elongated member 245 and a hinged/spring loaded components 250. Such spring biased or spring loaded hinge clips are well known to those skilled in the art. In operation, a user will apply a force such that the elongated member 245 of the second spring biased clip moves away from the back section of the hollow body (as illustrated in FIG. 2A). Next, a user may insert a cleaning cloth 240 between the elongated member and the back section of the hollow body. As force is removed from the elongated body, the biasing force of the spring biased clip causes the elongated body to be biased toward the back section, which retains the cleaning cloth between the spring biased clip and the back section of the hollow body (as illustrated in FIG. 2B). In the present embodiment, a somewhat curved shaped clip is used. However, it is within the spirit and scope of the invention to use other shapes and types of clips so that a cleaning material may be neatly stored within the hollow body.

FIG. 2B also illustrates a transparent pocket 230 affixed to the inside surface of the back section of the hollow body. The transparent pocket may be adapted to receive a label on which some other type of identifying information may be included. In operation, a user may hand write or type user information, such as name, address, email address, telephone number, onto the label and then insert the label into the transparent pocket. In this embodiment, a user to be contacted by a person that finds or locates the device when such device is lost or misplaced. In one embodiment, such transparent pocket or tab or label may be placed on the outside of the backside so that it is not visible when in use on a wearer's belt or clothing. It is worth nothing that both the second hinged biased clip and transparent pocket may be positioned on different surface within the cavity so long as such position does not interfere with the positioning of the glasses.

In operation, in order for a user to install the device on a wearer's belt, a force must be applied to the elongated member 346 of the spring biased hinge clip such that the first end of the spring biased hinge clip pivots away from the back section 120 of the hollow body. Next, a user may position the elongated member 346 of the spring biased hinged clip such that a belt strap is between the elongated member of the spring biased hinged clip and the back section of the hollow body. Next, as the force pivoting the elongated member is removed, the hollow body and the elongated member 346 become substantially parallel to one another as illustrated in FIG. 4B. As illustrated in FIG. 4B, the terminating end of catching a feature 315 is positioned substantially perpendicular to the downward facing surface 436 of the belt 430. The catching feature acts as a stop and makes it substantially more difficult for the hollow body to be moved from the belt when upward forces act on it.

Figure 3B:
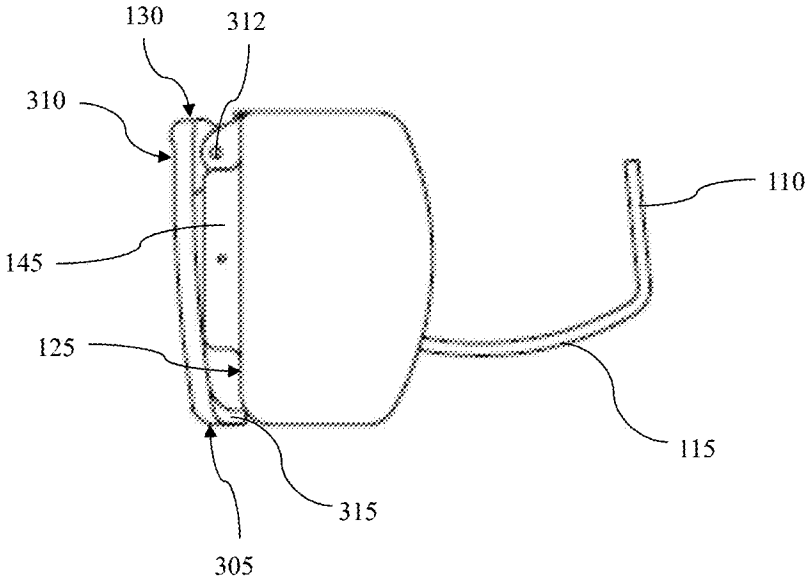
FIG. 3B is an illustration of a side view of the device for carrying eyewear in the open position, according to one embodiment of the present invention.
Figure 3C:
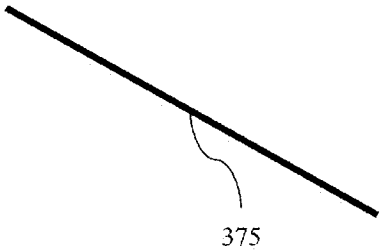
FIG. 3C is an illustration of a prospective view of an elongated shaped body for removing a communication tag from a pocket of the device.
Figure 3A:
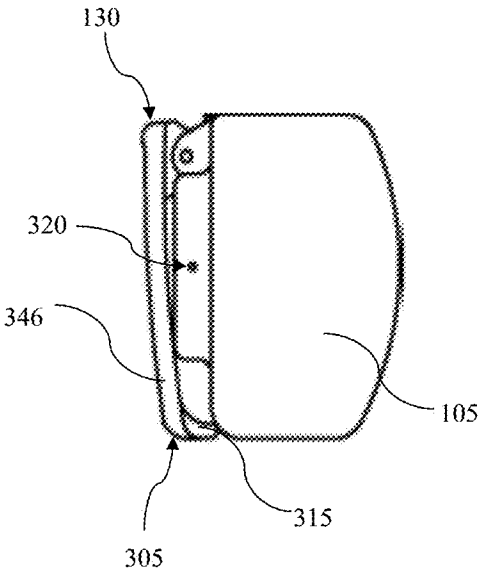
FIG. 3A is an illustration of a side view of the device for carrying eyewear in the closed position, according to one embodiment of the present invention.
Figure 4A:
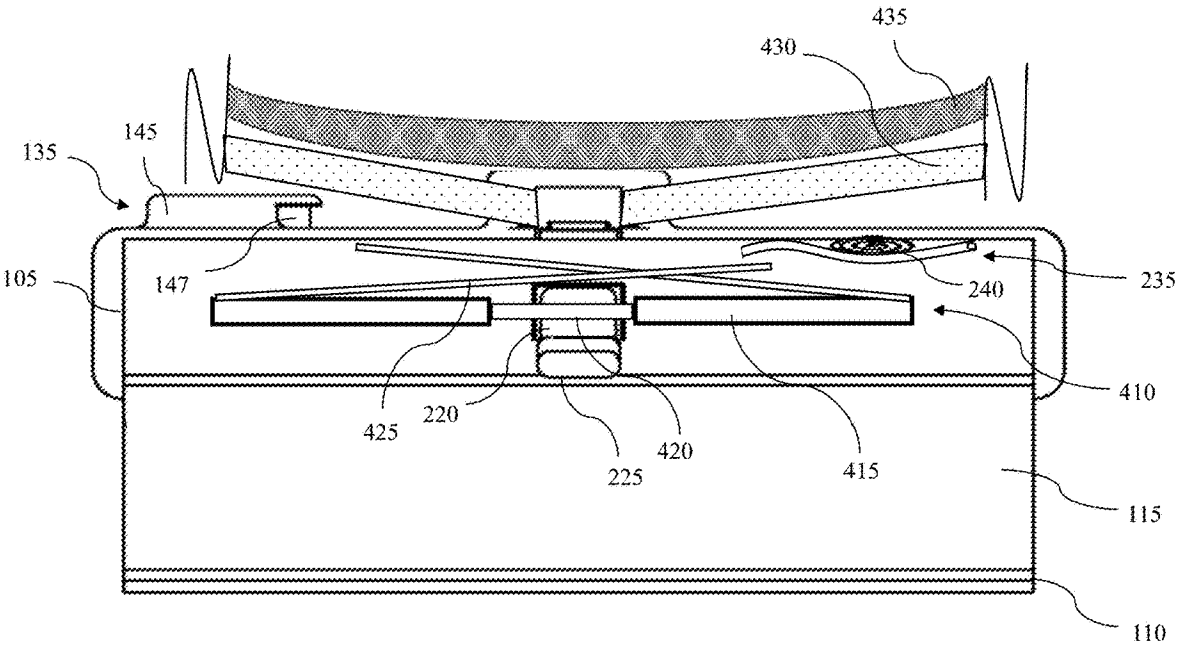
FIG. 4A is an illustration of a top view of the device for carrying eyewear in the open position having eyewear inside and attached to a waist belt, according to one embodiment of the present invention.

In order to open the case to insert eyewear into the cavity 205 of the hollow body, a force must act upon the top section 110 and front section 115 in order to pivot the front section and top section away from the back section of the device (as illustrated in FIG. 3B). With the top and front section pivoted away from the back section, a user can more easily access the cavity of the hollow body from above the device. Next, as explained above, the user apply force to the elongated member 245 of the second spring biased hinged clip so that the elongated member 245 moves away from the back section so that a cleaning cloth may be positioned neatly against the back section of the hollow body. After in place, the force applied to the elongated member can be removed in order for the spring force to bias the elongated member toward the back section thereby securing the cleaning cloth against an inside surface.

When the hollow body is an open position as illustrated in FIG. 2B, eyeglasses may be inserted into the eyeglasses such that the nose bridge 420 of the eyewear rests on the nose bridge feature 220. As explained above, the concave profile of the finger 225 provides a user to easily place the eyeglasses in a particular position inside of the hollow body, while at the same time provides a stop for preventing eyewear from inadvertently falling out of the hollow body. After the eyewear is in place, force can be applied onto the front section and top section of the hollow body in order close the device into the closed state as illustrated in FIG. 4B.

Figure 6:
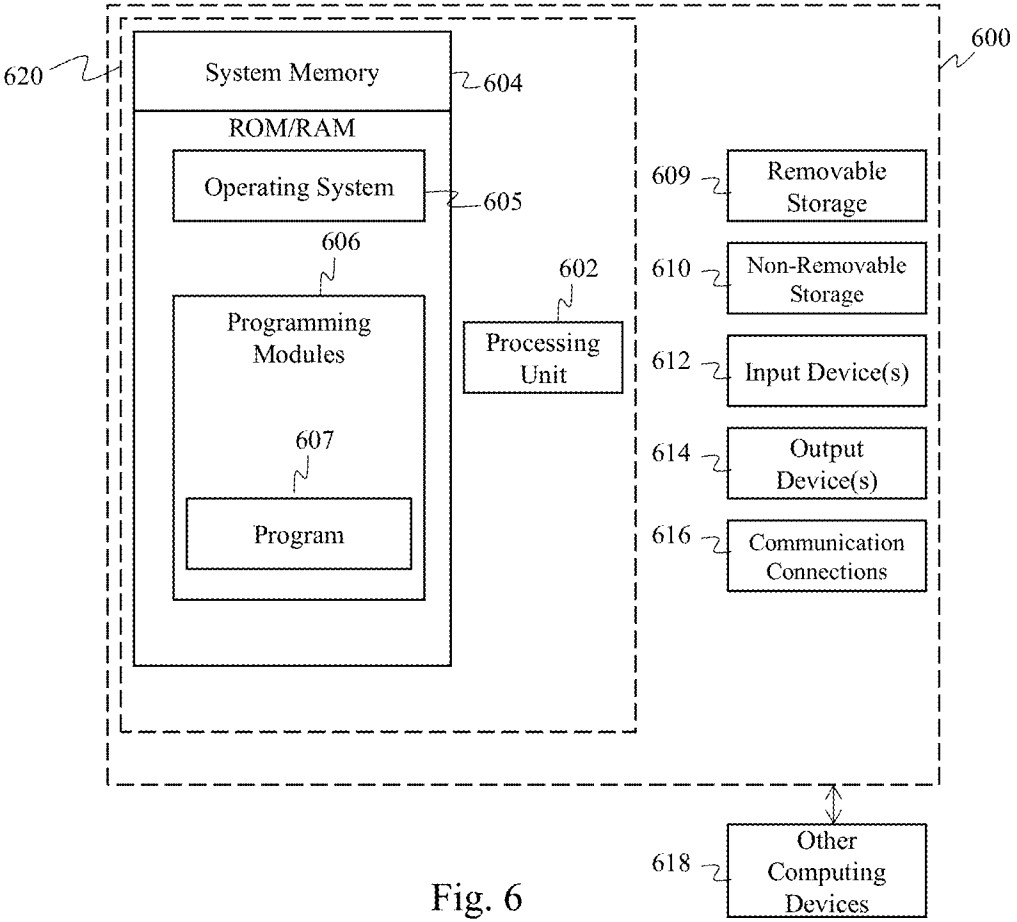

FIG. 6 is a block diagram of a system including an example computing device 600 and other computing devices. Consistent with the embodiments described herein, the aforementioned actions performed by remote computing device 505 and communications device 147 may be implemented in a computing device, such as the computing device 600 of FIG. 6. Any suitable combination of hardware, software, or firmware may be used to implement the computing device 600. The aforementioned system, device, and processors are examples and other systems, devices, and processors may comprise the aforementioned computing device. Remote computing device 505 and communications device 147 may operate in other environments and are not limited to computing device 600.

With reference to FIG. 6, a system consistent with an embodiment of the invention may include a plurality of computing devices, such as computing device 600. In a basic configuration, computing device 600 may include at least one processing unit 602 and a system memory 604. Depending on the configuration and type of computing device, system memory 604 may comprise, but is not limited to, volatile (e.g. random access memory (RAM)), non-volatile (e.g. read-only memory (ROM)), flash memory, or any combination or memory. System memory 604 may include operating system 605, and one or more programming modules 606. Operating system 605, for example, may be suitable for controlling computing device 600's operation. In one embodiment, programming modules 606 may include, for example, a program module 607 for executing the actions of server 102 and computing device 150, for example. Furthermore, embodiments of the invention may be practiced in conjunction with a graphics library, other operating systems, or any other application program and is not limited to any particular application or system. This basic configuration is illustrated in FIG. 6 by those components within a dashed line 620.

Computing device 600 may have additional features or functionality. For example, computing device 600 may also include additional data storage devices (removable and/or non-removable) such as, for example, magnetic disks, optical disks, or tape. Such additional storage is illustrated in FIG. 6 by a removable storage 609 and a non-removable storage 610. Computer storage media may include volatile and nonvolatile, removable and non-removable media implemented in any method or technology for storage of information, such as computer readable instructions, data structures, program modules, or other data. System memory 604, removable storage 609, and non-removable storage 610 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 600. Any such computer storage media may be part of device 600. Computing device 600 may also have input device(s) 612 such as a keyboard, a mouse, a pen, a sound input device, a camera, a touch input device, etc. Output device(s) 614 such as a display, speakers, a printer, etc. may also be included. The aforementioned devices are only examples, and other devices may be added or substituted.

Computing device 600 may also contain a communication connection 616 that may allow device 600 to communicate with other computing devices 618, such as over a network in a distributed computing environment, for example, an intranet or the Internet. Communication connection 616 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, Bluetooth™ technology, WIFI, infrared technology, ZigBee technology and other wireless media. The term computer readable media as used herein may include both computer storage media and communication media.

As stated above, a number of program modules and data files may be stored in system memory 604, including operating system 605. While executing on processing unit 602, programming modules 606 (e.g. program module 607) may perform processes including, for example, one or more of the stages of the process 500 as described above. The aforementioned processes are examples, and processing unit 602 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the invention.

In one embodiment, a second spring biased hinged clip 235 is coupled to an inside surface of the back section of hollow body. The second spring biased hinged clip is configured for retaining against the inside surface of the hollow body a piece of material for cleaning eyewear lens. In many cases, the piece of cleaning material cannot be properly fit inside of an eyewear case. Eyewear cases have a limited amount of space for carrying items. Many times there is not room inside of a case to carry both a cleaning cloth and eyewear. Many times a cleaning cloth haphazardly inserted into an eyewear case and can cause the eyewear to not properly fit inside the case, which may damage the eyewear. In the present embodiment the second spring biased hinge clip or spring loaded clip allows a user to properly restrain a cleaning cloth against the inside surface of the back section of the hollow body (illustrated in FIGS. 2B and 4A). More room is provided for eyewear inside the cavity by restraining the cleaning cloth against the inside surface of the back section.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. A device for carrying eyewear comprising:

a hollow body defining a cavity configured for receiving eyewear;

an upwardly protruding feature inside the cavity protruding upward from a bottom section of the body, wherein said upwardly protruding feature is adapted for maintaining said eyewear in a particular position when said eyewear is inside the cavity;

wherein a front section and top section of said hollow body is pivotally coupled to a bottom section of the body, wherein the front section and top section are configured to open away from a back section of said body to provide access to the cavity from above the hollow body;

a spring biased hinged clip coupled to an outward facing surface of the back section of the body, wherein the spring biased hinged clip is configured to couple the hollow body to a waist belt, wherein the spring biased hinged clip comprises a catching feature at a first end of the spring biased hinged clip, and wherein the catching device defines a flange protruding inward toward the back section of the body;

a second spring biased hinged clip coupled to an inside surface of the hollow body, wherein the second spring biased hinged clip is configured for retaining against an inside surface of the hollow body a piece of material configured for cleaning an eyewear lens;

a pocket coupled to the outward facing surface of the back section of the hollow body, wherein the pocket is configured to hold to a communication tag configured for wireless communication with a monitoring device; and, a communication tag configured for transmitting a signal to a monitoring device, wherein the signal is configured for being received by the monitoring device, and wherein the monitoring device is configured for monitoring a proximity of the communication tag relative to the monitoring device based upon the signal received, and wherein the monitoring device is configured for sending an alert message for display on a user interface of a remote computing device if the monitoring device determines that the proximity is greater than a threshold proximity.

2. The device of claim 1, wherein said eyewear is a pair of eye-glasses.

3. The device of claim 1, wherein said eyewear is a pair of sunglasses.

4. The device of claim 1, wherein the pocket comprises a pinhole opposing an open end of the pocket, wherein the pinhole is configured for allowing an elongated shaped body to push the communication tag out of the open end of the pocket.

5. The device of claim 1, wherein the communication tag and monitoring device includes Bluetooth™ technology.

6. A device for carrying eyewear comprising:

a hollow body defining a cavity configured for receiving;

an upwardly protruding feature inside the cavity protruding upward from a bottom section of the body, wherein said upwardly protruding feature is adapted for maintaining said eyewear in a particular position when said eyewear is inside the cavity eyewear;

wherein a front section and top section of said hollow body is pivotally coupled to a bottom section of the body, wherein the front section and entire top section are configured to open away from a back section while a pair of side sections remain attached to the back section such that the upwardly protruding feature, entire top section, entire side sections and front section prevent items from falling when placing items inside the cavity and to provide access to the cavity from above and from in front of the hollow body; and, an attaching device coupled to an outward facing surface of the body, wherein the attaching device is for attaching the hollow body to a portion of an article of clothing.

7. The device of claim 6, wherein the attaching device comprises a spring biased hinged clip coupled to an outward facing surface of the back section of the body, wherein the spring biased hinged clip is configured to couple to a portion of an article of clothing.

8. The device of claim 7, wherein the spring biased hinged clip comprises a catching feature at a first end of the hinged clip, wherein the catching device defines a flange protruding inward toward the back section of the hollow body and wherein the catching feature is configured for interacting with a downward facing surface of a belt strap when the spring biased clip is fastened onto a belt strap such that the hollow body stays on the belt when upward forces act on the hollow body.

9. The device of claim 6, wherein the device further comprises a pocket coupled to the outward facing surface of the back section of the hollow body, wherein the pocket is configured to hold to a communications tag configured for wireless communication with a monitoring device.

10. The device of claim 9, wherein the pocket comprises a pinhole opposing an open end of the pocket, wherein the pinhole is configured for allowing an elongated shaped body to push a communication tag out of the open end of the pocket.

11. The device of claim 9, wherein the device further comprises a communication tag configured for transmitting a signal to a monitoring device, wherein the signal is configured for being received by the monitoring device, and wherein the monitoring device is configured for monitoring a proximity of the communication tag relative to the monitoring device based upon the signal received, and wherein the monitoring device is configured for sending an alert message for display on a user interface of a remote computing device if the monitoring device determines that the proximity is greater than a threshold proximity.

12. The device of claim 6, wherein the attaching device comprises a first magnet configured to mate with a second magnet, wherein the first magnet is coupled to the outside of said back section and the second magnet is adapted to be positioned on an article of clothing proximate to a waist of a wearer.

13. The device of claim 6, wherein the attaching device is a fastener having a first part adapted to mate with a second part, wherein the first part is coupled to the outward facing surface of the back section and the second part is adapted to be positioned on an article of clothing proximate to a waist of a wearer.

14. The device of claim 6, wherein the device further comprises a second spring biased hinged clip coupled to an inside surface of the hollow body, wherein the second spring biased hinged clip is configured for retaining against an inside surface of the hollow body a piece of material configured for cleaning an eyewear lens.

15. A device for carrying eyewear comprising:

a hollow body defining a cavity configured for receiving eyewear;

an upwardly protruding feature inside the cavity protruding upward from a bottom section of the body, wherein said upwardly protruding feature is adapted for maintaining said eyewear in a particular position when said eyewear is inside the cavity eyewear;

wherein a front section and top section of said hollow body is pivotally coupled to a bottom section of the body, wherein the front section and entire top section are configured to open away from a back section while a pair of side sections remain attached to the back section such that the upwardly protruding feature, entire top section, entire side sections and front section prevent eyewear from falling when placing items inside the cavity and to provide access to the cavity from above and from in front of the hollow body such that as the case is attached to an article of clothing a person can easily position the device using one hand; and, an attaching device coupled to an outward facing surface of the body, wherein the attaching device is for attaching the hollow body to a portion of an article of clothing; and, a pocket coupled to the outward facing surface of the back section of the hollow body, wherein the pocket is configured to hold to a communication tag configured for wireless communication with a monitoring device.

16. The device of claim 15, wherein the device further comprises a communication tag configured for transmitting a signal to a monitoring device, wherein the signal is configured for being received by the monitoring device, and wherein the monitoring device is configured for monitoring a proximity of the communication tag relative to the monitoring device based upon the signal received, and wherein the monitoring device is configured for sending an alert message for display on a user interface of a remote computing device if the monitoring device determines that the proximity is greater than a threshold proximity.

17. The device of claim 15, a second spring biased hinged clip coupled to an inside surface of the hollow body, wherein the second spring biased hinged clip is configured for retaining against an inside surface of the hollow body a piece of material configured for cleaning an eyewear lens.

18. The device of claim 15, wherein said eyewear is a pair of eye-glasses.

19. The device of claim 15, said eyewear is a pair of sunglasses.

* * * * *